United States Patent [19]

Weagley et al.

[11] Patent Number: 4,960,666

[45] Date of Patent: Oct. 2, 1990

[54] TONER AND DEVELOPER COMPOSITIONS WITH POLYSILYLENES

[75] Inventors: Ronald J. Weagley, Albuquerque, N. Mex.; Timothy J. Fuller, West Henrietta; Michael J. Levy, Webster, both of N.Y.

[73] Assignee: Xerox Corporation, Stamford, Conn.

[21] Appl. No.: 316,069

[22] Filed: Feb. 27, 1989

[51] Int. Cl.[5] ..... G03G 9/08; G03G 9/12

[52] U.S. Cl. ..... 430/109; 430/114; 430/904

[58] Field of Search ..... 528/9, 10; 556/430; 430/109, 114, 904

[56] References Cited

U.S. PATENT DOCUMENTS

| | | | |
|---|---|---|---|
| 3,655,374 | 4/1972 | Palermiti et al. | 430/121 |
| 3,850,829 | 11/1974 | Smith et al. | 430/113 |
| 3,983,045 | 9/1976 | Jugle et al. | 430/110 |
| 4,430,408 | 2/1984 | Sitaramiah | 430/106.6 |
| 4,560,635 | 12/1985 | Hoffend et al. | 430/106.6 |
| 4,618,551 | 10/1986 | Stolka et al. | 430/58 |
| 4,770,968 | 9/1988 | George set al. | 430/108 |
| 4,839,451 | 6/1989 | Badesha et al. | 556/430 X |

FOREIGN PATENT DOCUMENTS

| | | | |
|---|---|---|---|
| 61-87729 | 5/1986 | Japan | 528/9 |
| 61-200130 | 9/1986 | Japan | 528/9 |

OTHER PUBLICATIONS

Trujillo, *Journal of Organometallic Chemistry,* vol. 198, p. 627, 1980.

Zhang and West, *Journal of Polymer Science,* vol. 22, p. 225, 1984.

Zhang and West, *Juornal of Polymer Sciences,* vol. 22, p. 159, 1984.

*Primary Examiner*—Jose Dees
*Assistant Examiner*—Jeffrey A. Lindeman
*Attorney, Agent, or Firm*—E. O. Palazzo

[57] ABSTRACT

A toner and developer composition comprised of polysilylenes, poly(germylenes), or mixtures thereof.

35 Claims, No Drawings

TONER AND DEVELOPER COMPOSITIONS WITH POLYSILYLENES

BACKGROUND OF THE INVENTION

The present invention is generally directed to toner and developer compositions, and more specifically the present invention is directed to imaging and printing processes with toner compositions, including magnetic single component liquid developers, and two component developer compositions containing polysilylenes. In one embodiment of the present invention there are provided toner compositions comprised of a polysilylene, a poly(germane), or mixtures thereof, and pigment particles. More specifically, in one embodiment the present invention is directed to low melting toner composition comprised of a polysilylene, pigment, or dye particles, and optional additive particles. Also encompassed by the present invention are developer compositions comprised of the aforementioned toner and carrier components. Examples of advantages associated with the toner compositions of the present invention include a lower minimum fixing temperature than many currently known toners, for example 125° C., thereby permitting decreased power consumption and increasing the fuser roll life present in electrophotographic imaging processes; and nonblocking at temperatures of between about 118° C. and less than about 140° C., and specifically nonblocking at temperatures of from about 48° C. to about 55° C. There is also provided in accordance with the present invention imaging processes with positively or negatively charged toner compositions comprised of polysilylene resin particles, pigment particles, and charge enhancing additives. In addition, the present invention is directed to imaging processes with developer compositions comprised of the aforementioned toners, and carrier particles. Further, the processes of the present invention with the toner and developer compositions illustrated, including single component toners, enable reliable output copy quality and stable triboelectric charging properties for the toner compositions selected. Also, the present invention relates to liquid toner and developer compositions comprised of the polysilylenes, poly(germanes) or mixtures thereof illustrated herein; vehicles such as known Isopars, including Isopar G; and charge directors, reference U.S. Pat. No. 3,850,829, the disclosure of which is totally incorporated herein by reference.

Many toner and developer compositions are known. For example, toner compositions with styrene acrylates, styrene methacrylates, polyesters, styrene butadienes, and the like are illustrated in the prior art. Also, toners with additives including charge enhancing components, metal salts, metal salts of fatty acids, colloidal silica, and the like are known. Further, developer and toner compositions with certain waxes therein are known. For example, there are disclosed in U.K. Patent Publication 1,442,835, the disclosure of which is totally incorporated herein by reference, toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374, the disclosure of which is totally incorporated herein by reference. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates such as papers wherein there are selected toner compositions containing specific external lubricants including various waxes, see column 5, lines 32 to 45.

Other references of interest which disclose, for example, the use of amides as toner additives include U.S. Pat. No. 4,072,521; 4,073,649 and 4,076,641. Furthermore, references of background interest are U.S. Pat. Nos. 3,165,420; 3,236,776; 4,145,300; 4,271,249; 4,556,624; 4,557,991 and 4,604,338.

Moreover, toner compositions with charge enhancing additives are known including, for example, distearyl dimethyl ammonium methyl sulfate, reference U.S. Pat. No. 4,560,635, the disclosure of which is totally incorporated herein by reference. As preferred carrier components for the aforementioned compositions, there are selected steel or ferite materials, particularly with a polymeric coating thereover, including the coatings as illustrated in U.S. Ser. No. 751,922, entitled Developer Composition with Specific Carrier Particles, the disclosure of which is totally incorporated herein by reference. A particularly preferred coating illustrated in the aforementioned copending application is comprised of a copolymer of vinyl chloride and trifluorochloroethylene with conductive substances dispersed in the polymeric coating inclusive of, for example, carbon black. One embodiment disclosed in the aforementioned copending application is a developer composition comprised of styrene butadiene copolymer resin particles, and charge enhancing additives selected from the group consisting of alkyl pyridinium halides, ammonium sulfates, and organic sulfate or sulfonate compositions; and carrier particles comprised of a core with a coating of vinyl copolymers, or vinyl homopolymers. The polymeric components of the aforesaid copending application are also selected for various embodiments of the present invention as illustrated herein. Additionally, there is described in the U.S. Pat. No. 3,893,935 the use of certain quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. Nos. 3,944,493; 4,007,293; 4,079,014 and 4,394,430.

There were located as a result of a patentability search U.S. Pat. Nos. 3,850,829; 4,430,408 and 4,770,968. In the '829 patent there are illustrated liquid developers comprised of an organosol portion, reference the Abstract of the Disclosure, and particularly the organosol as illustrated in columns 3 and 4. Note Example A wherein there is formulated an organosol part by mixing 250 grams of silicon resin with 250 grams of Isopar G, and wherein the silicon resin is an organopolysiloxane of the formula as illustrated in column 3, line 60. The '408 patent describes developer powders containing a fluorene modified alkyl siloxane and a surface treatment of carbon black, reference the Abstract of the Disclosure. The '968 patent illustrates polysilane styrene butadiene terpolymers and the use thereof in toner and developer compositions.

Although the above described toner and developer compositions are useful for their intended purposes, there is a need for improved compositions. More specifically, there is a need for toner compositions wherein other polymer resins are selected. There is also a need for low melting toner compositions with the advantages illustrated herein. Further, there is a need for toner resins comprised of polysilylenes, or polyorganosilanes, poly(germanes), or mixtures thereof. In addition, there is a need for toner compositions wherein the amount of power needed for the melting thereof is decreased from, for example, about 10 to about 25 percent, and wherein fuser roll life is increased as indicated herein. There is also a need for developer compositions comprised of the toner compositions illustrated herein and carrier components. The toner and developer compositions of the present invention can be selected for electrophotographic imaging and printing processes, especially xerographic processes as illustrated, for example, in many of the U.S. patents mentioned herein. Also, the polysilylenes and the other referenced toner resin components of the present invention may be selected as carrier coatings, or as coatings for fuser rolls.

Furthermore, the polysilylenes, poly(germanes), or mixtures thereof may be selected as resin components for liquid toner compositions containing, for example, petroleum distillates such as the known Isopars and a charge director such as barium petronate, lecithin, and the like, which charge directors are usually present in an amount of from about 0.1 to about 15 weight percent. Moreover, there is a need for toner compositions containing a polysilylene or a poly(germane) with glass transition temperatures of from about 50° to about 60° C., and with melting temperatures of from between about 50° C. to about 120° C. in some embodiments.

SUMMARY OF THE INVENTION

It is an object of the present invention to provide toner and developer compositions with many of the advantages illustrated herein.

Another object of the present invention resides in the provision of toner compositions with polysilylenes, poly(germanes), and mixtures thereof.

In another object of the present invention there are provided developer compositions comprised of toner compositions and carrier components.

Moreover, another object of the present invention resides in the provision of toner compositions with polysilylenes, polysilanes, polyorganosilanes, polygermylenes, or mixtures thereof, pigment particles, and optional additive particles.

Further, another object of the present invention resides in the provision of low melting, for example from about 50 ° to about 150° C., toner compositions with polysilylenes, polysilanes, polyorganosilanes, or mixtures thereof, pigment particles, and optional additive particles.

Also, in another object of the present invention there are provided toner compositions that require less energy consumption for melting thus enabling, for example, an extension of fuser rolls present in electrophotographic imaging processes.

Further, in another object of the present invention there are provided liquid developer compositions comprised of polysilylenes, polygermylenes, or mixtures thereof as illustrated herein.

Another object of the present invention resides in the provision of colored toner compositions including those selected for photoelectrophoresis color imaging systems.

In yet another object of the present invention there are provided toner compositions including liquid toner compositions comprised of the polysilylenes, polygermylenes, or mixtures thereof as illustrated hereinafter.

Additionally, in yet another object of the present invention there are provided imaging and printing processes with the toner and developer compositions illustrated herein.

These and other objects of the present invention are accomplished by providing toner compositions and developer compositions. More specifically, the present invention is directed to toner compositions comprised of polysilylenes, polygermylenes, or mixtures thereof. In one embodiment of the present invention, there are provided low melting toner compositions comprised of a polysilylene and a pigment, or dye. Another embodiment of the present invention is directed to developer compositions comprised of the aforementioned toners and carrier particles. Additionally, the toner compositions of the present invention may include as additives, preferably external additives, in amounts, for example, of from about 0.1 to about 3.0 percent, and preferably from about 1.0 to about 0.5 percent by weight of silica such as Aerosil R972, metal salts, metal salts of fatty acids such as zinc stearate, and the like, reference U.S. Pat. Nos. 3,720,617; 3,900,588 and 3,590,000, the disclosures of which are totally incorporated herein by reference.

Illustrative examples of specific polysilylene toner resins selected for the toner and developer compositions and present in various effective amounts, such as, for example, from about 40 percent by weight to about 80 percent by weight, and providing the total amount of all components is equal to about 100 percent by weight, include those as illustrated in U.S. Pat. No. 4,618,551, the disclosure of which is totally incorporated herein by reference. Specific polysilylenes selected for the toner compositions of the present invention are of the formula

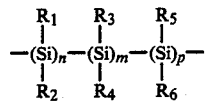

wherein $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that reflect the percentage of the particular monomer unit in the total polymer compound. Preferred polysilylenes include poly(methylphenyl silylenes), which polysilylenes preferably have a weight average molecular weight of in excess of 1,000, such as from about 5,000 to about 2,000,000. Polysilylenes or polygermylenes with a weight average molecular weight of from about 75,000 to about 1,000,000 are usually selected in some embodiments. The aforementioned polysilylenes can be prepared by known methods, reference the *Journal of Organometallic Chemistry*, Vol. 198, C27, (1980), R. E. Trujillo, the disclosure of which is totally incorporated herein by reference. Also, other polysilylenes can be prepared as described in the *Journal of Polymer Science*, Polymer Chemistry Edition, Vol. 22, pages 225 to 238, (1984), John Wiley and Sons, Inc., the disclosure of which is totally incorporated herein by reference. More specifically, the aforementioned polysilylenes can be prepared as disclosed in the aforesaid article by the condensation of a dichloromethylphenyl silane with an alkali metal such as sodium. In one preparation sequence, there is reacted a dichloromethyl phenyl silane in an amount of from about 0.1 mole with sodium metal in the presence of 200 milliliters of solvent in which reaction is accomplished at a temperature of from about 100° C. to about 140° C. There results, as identified by elemental analysis, infrared spectroscopy, UV spectroscopy, and nuclear magnetic resonance, the polysilylene products subsequent to the separation thereof from the reaction mixture.

Illustrative specific examples of polysilylene compounds that may be selected for the toner compositions of the present invention include poly(methylphenyl silylene), poly(methylphenyl silylene-co-dimethyl silylene), poly(cyclohexylmethyl silylene), poly(tertiarybutylmethyl silylene), poly(phenylethyl silylene), poly(n-propylmethyl silylene), poly(p-tolylmethyl silylene), poly(cyclotrimethylene silylene), poly(cyclotetramethylene silylene), poly(cyclopentamethylene silylene), poly(di-t-butyl silylene-co-di-methyl silylene), poly(diphenyl silylene-co-phenylmethyl silylene), poly(cyanoethylmethyl silylene), poly(phenylmethyl silylene), and the like. Preferred polysilylenes selected for the toner compositions of the present invention include poly(methylphenyl) silylene, poly(cyclohexylmethyl) silylene, and poly(phenethylmethyl) silylene.

Examples of pigment particles include carbon blacks, magnetites, such as Mapico Black, mixtures thereof, and the like. Magnetites are generally present in the toner composition in an amount of from about 5 percent by weight to about 70 percent by weight, and preferably in an amount of from about 15 percent by weight to about 60 percent by weight. Pigment particles such as carbon black, including Regal 330®, are usually present in an amount of from about 1 to about 20, and preferably from 5 to about 15 percent by weight. Alternatively, there can be selected mixtures of magnetites with pigment particles such as carbon black or equivalent pigments, which mixtures, for example, contain from about 5 percent to about 60 percent by weight of magnetite, and from about 0.5 percent to about 10 percent by weight of carbon black. Also, there may be selected hard, or acicular magnetites in amounts of from about 15 to about 40, and preferably from about 20 to aboutt 30 percent by weight. Examples of hard magnetites include MO4232 available from Pfizer Chemical. In another embodiment of the present invention, the toner compositions may include as pigment particles magnetites in an amount of from about 35 to about 75 percent by weight, and preferably about 15 percent by weight.

As preferred magnetites selected for the toner compositions for the processes of the present invention, the magnetites as illustrated in U.S. Pat. No. 4,517,268, the disclosure of which is totally incorporated herein by reference, are utilized.

Illustrative examples of optional charge enhancing additives present in the toner or admixed therewith in various effective amounts such as, for example, from about 0.05 to about 10 percent by weight, and more preferably from about 0.5 to about 2 percent by weight, and usually enabling positively charged toner compositions with a triboelectric charge, for example, of from about 15 to about 40 microcoulombs per gram, include alkyl pyridinium halides, such as cetyl pyridinium chlorides, reference U.S. Pat. No. 4,298,672, the disclosure of which is totally incorporated herein by reference; cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate, Broton P51 available from Orient Chemical Company; TP-302, a quaternary ammonium salt available from Nachem, Inc.; charge control agents which have been surface treated with colloidal silicas such as Aerosils; mixtures of colloidal silicas and charge additives; colloidal silicas surface treated with charge control additives; and other known similar charge enhancing additives providing the objectives of the present invention are accomplished; and the like. Examples of charge enhancing additives present in various effective amounts such as, for example, from about 0.05 to about 10 percent by weight, and preferably from about 1 to about 5 percent by weight, and more preferably from about 0.5 to about 2 weight percent that enable negatively charged toners with a triboelectric charge, for example, of from about −15 to about −40 microcoulombs per gram include Spilon TRH available from Hodogaya Chemical, orthohalophenylcarboxylic acids, reference U.S. Pat. No. 4,411,974, the disclosure of which is totally incorporated herein by reference, potassium tetraphenyl borates, and the like. With respect to the aforementioned positively charged toners, depending on a number of factors including the carrier selected and the amount of charge enhancing additive utilized, generally the triboelectric charge is from about a +15 microcoulombs per gram to about a +40 microcoulombs per gram, and preferably from a +20 microcoulombs per gram to about a +35 microcoulombs per grams. A similar charge with a negative polarity can be present on the toner with negative charge enhancing additives such as toner of the '974 patent.

Illustrative examples of carrier particles that can be selected for mixing with the toner compositions, thus permitting two component developers, include those particles that are capable of triboelectrically obtaining a charge of opposite polarity to that of the toner particles. Accordingly, the carrier particles can be selected to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include steel, nickel, iron, ferrites, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover, several of which are illustrated, for example, in U.S. Ser. No. 751,922 relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers illustrated in the copending application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride and trichlorofluoroethylene; and other known coatings. There can also be selected as carriers components comprised of a core with a double polymer coating thereover, reference U.S. Ser. Nos. 136,791, and 136,792, the disclosures of which are totally incorporated herein by reference. More specifically, there is detailed in these applications a process for the preparation of carrier particles with substantially stable conductivity parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, thus allowing these particles to possess sufficient density to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed.

The toner compositions illustrated herein can be prepared by a number of known methods, including mechanical blending and melt blending the toner polymer resin particles, pigment particles or colorants, followed by mechanical attrition. Other methods include those well known in the art such as spray drying, mechanical dispersion, melt dispersion, dispersion polymerization, extrusion, and suspension polymerization. More specifically, the toner compositions are prepared by the simple mixing of polymeric resin, magnetite, and additive particles while heating, followed by cooling, micronization to enable toner size particles of, for example, an average diameter of from about 10 to about 25 microns, and subsequently classifying these particles for the primary purpose of removing fines, that is for example particles with a diameter of 5 microns or less, and very large coarse particles, that is with a diameter of greater than 30 microns. Also, the aforementioned toners can be prepared in a similar manner with an extrusion device wherein the product exiting from such a device is severed into pieces followed by micronization and classification.

As indicated herein, the toner and developer compositions of the present invention may be selected for use in developing images in electrophotographic imaging systems, containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, and vanadyl phthalocyanines, while examples of charge transport layers include the aryl amines as disclosed in U.S. Pat. No. 4,265,990. Moreover, there can be selected as photoconductors hydrogenated amorphous silicon, and as photogenerating pigments squaraines, perylenes, and the like.

An especially preferred developer composition of the present invention is comprised of a toner composition with 88 weight percent of methylpolysilylene, about 10 percent by weight of carbon black, such as Regal 330®, and about 2.0 percent by weight of the charge enhancing additive distearyl dimethyl ammonium methyl sulfate, and carrier particles comprised of a steel core with a coating thereover of a polymer of, for example, a vinyl chloride/trichlorofluoroethylene copolymer available as FPC 461, which coating has dispersed therein conductive components such as carbon black particles. Other preferred carrier coatings include those comprised of steel with two polymer coatings thereover as illustrated in the aforementioned copending applications, particularly coatings comprised of 60 percent by weight of Kynar and 40 percent by weight of polymethylmethacrylate, or 70 percent by weight of Kynar and 30 percent by weight of polymethylmethacrylate. The carrier coating weights are dependent on a number of factors including the carrier core selected and the other components present in the developer composition. Generally, however, the coating weight is from about 0.1 percent to about 5 percent, and preferably from about 1 percent to about 3 percent by weight.

The optional additives illustrated herein, such as metal salts of fatty acids, colloidal silicas, and the like, are usually present as external components in the amounts indicated herein, and preferably in an amount of from about 0.5 to about 0.7 weight percent. Also, the toner compositions of the present invention may include in place of carbon black colorants or colored pigments such as red, blue, pink, brown, magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy aceto-acetanilide, Permanent Yellow FGL, red, blue, green, brown, Lithol Scarlett, and the like. These pigments are generally present in the toner composition in an amount of from about 2 weight percent to about 15 weight percent based on the weight of the toner resin particles.

There are also provided in accordance with the present invention electrophotographic imaging and printing processes including a xerographic process which comprises forming a latent image on an imaging member; developing the image with the toner compositions illustrated herein; subsequently transferring the image to a suitable substrate; and thereafter permanently affixing the image by, for example, heating or a combination of heating and pressure.

The following examples are being submitted to further define various species of the present invention. These examples are intended to illustrate and not limit the scope of the present invention. Also, parts and percentages are by weight unless otherwise indicated.

EXAMPLE I

There was prepared by melt blending with heating, followed by mechanical attrition, a toner composition comprised of 74 weight percent of monomodal poly(-beta-phenethylmethylsilylene) with a weight average molecular weight of 300,000 and a number average molecular weight of 140,000, 16 weight percent of the magnetite Mapico Black and 10 percent by weight of Regal 330® carbon black by mixing and melt extruding at 130° for 10 hours. The resulting homogenous mixture was grounded with a blender for about 1 minute, and thereafter jetted into toner particles with an average volume diameter of about 12 microns subsequent to classification with an alpine air sieve. Subsequently, a postively charged toner with a triboelectric charge thereon of 15.5 microcoulombs per gram as determined by the known Faraday cage apparatus was prepared by admixing and surface treating in a coffee grinder for 0.5 minute 2 grams of the above formed toner with 0.12 gram of a 1:1 ratio of Aerosil R972, TP-302, a quaternary ammonium salt available from Nachem Inc.

Subsequently, there was prepared a developer composition by admixing the aforementioned formulated toner composition at about 3 percent toner concentration, that is 3.3 parts by weight of toner per 100 parts by weight of carrier, which carrier was comprised of 60 grams of a steel core with a coating thereover, 0.65 coating weight of a mixture of a first polymer of Kynar, 70 percent, and a second polymer of polymethylmethacrylate, 30 percent.

The aforementioned developer composition was utilized to develop latent images generated in a xerographic imaging fixture (Xerox Model D) with a negatively charged selenium photoreceptor, and there resulted images of excellent resolution with substantially no background deposits. The minimum fixing temperature for affixing the developed image to a paper substrate after transfer thereto was about 250° F. to about 275° F., and no undesirable offsetting (120° to 135° C.) to the silicone fuser roll present resulted.

The toner polymer silylene resin was prepared by heating 19.1 grams of lump sodium and 225 milliliters of dry toluene at about 110° C. followed by rapid stirring resulting in a uniform sodium dispersion. Thereafter, 75 milliliters of beta-phenethylmethyldichlorosilane was added to the aforementioned dispersion at a rate of 5.1 milliliters per minute with a syringe pump. The slurry resulting was then heated for 2 hours and 10 milliliters of trimethoxymethane terminating agent was added followed by refluxing for 30 minutes. The mixture was then diluted with 100 milliliters of dry toluene and filtered hot to remove undesirable side product salts. The polymer product poly(beta-phenethylmethylsilylene) with a weight average molecular weight of 300,000 as determined by gel permeation chromotography (GPC) and a number average molecular weight of 140,000 as determined by GPC was obtained by precipitation of the toluene-polymer solution into the nonsolvent ethanol at five times the volume of toluene. Upon isolation by filtration, the polymer product was redissolved in toluene and precipitated into 10 times the toluene volume of acetone. The polymer product was isolated by filtration and dried to yield 14.3 grams, a 25 percent yield of the above product, which product was identified by infrared spectroscopy, gel permeation chromography, and differential scanning colorimetry.

EXAMPLE II

A positively charged toner composition with a triboelectric charge thereon of 18 microcoulombs per gram was prepared by repeating the procedure of Example I with the exceptions that there was selected 1.5 percent by weight of the charge additive TP-302 and 0.5 percent by weight of the Aerosil R972 with substantially similar results.

EXAMPLE III

A toner and developer composition was prepared by repeating the process of Example I with the exception that there was selected as the charge additive Broton P51, and substantially similar results were obtained.

EXAMPLE IV

A negatively charged toner composition with a triboelectric charge of −25 microcoulombs per gram was prepared by repeating the procedure of Example I with the exception that there was selected 5 weight percent of copper phthalocyanine in place of the carbon black and magnetite, and the carrier was coated with polyvinyl pyridine. Substantially similar results are believed to be obtained when this developer composition is utilized in a xerographic imaging fixture, such as the Xerox Corporation 1075® imaging apparatus, or the Xerox Model D imaging test fixture.

Other modifications of the present invention may occur to those skilled in the art subsequent to a review of the present application. The aforementioned modifications, including equivalents thereof, are intended to be included within the scope of the present invention.

What is claimed is:

1. A toner composition comprised of polysilylenes, poly(germylenes), or mixtures thereof, and pigment particles.

2. A toner composition comprised of a polysilylene and a pigment, or dye.

3. A toner composition in accordance with claim 1 wherein the a polysilylene or polysilylene mixtures of the formula

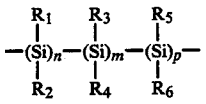

wherein $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that represent the percentage of the monomer unit in the total polymer.

4. A toner composition in accordance with claim 3 containing charge enhancing additives.

5. A toner composition in accordance with claim 3 containing as external additives colloidal silica, metal salts, or metal salts of fatty acids.

6. A toner composition in accordance with claim 3 containing pigment particles of carbon black, magnetites, or mixtures thereof.

7. A toner composition in accordance with claim 3 wherein the polysilylene is poly(methylphenyl) silylene, poly(cyclohexyl methyl) silylene, poly(beta-phenethylmethylsilylene), poly(n-propylmethyl silylene)-co-methylphenyl silylene, or poly(n-propylmethyl silylene).

8. A developer composition comprised of the toner composition of claim 1, and carrier components.

9. A developer composition comprised of the toner composition of claim 2, and carrier compenents.

10. A developer composition comprised of the toner composition of claim 3, and carrier components.

11. A developer in accordance with claim 9 wherein the carrier contains a polymeric coating.

12. A developer in accordance with claim 10 wherein the carrier contains a polymeric coating.

13. A developer in accordance with claim 12 wherein the polymeric coating is selected from the group consisting of polyvinylidine fluorides, polymethylmethacrylates, terpolymers of styrene methacrylate in an organosilylene, and polymer coatings not in close proximity in the triboelectric series.

14. A liquid developer composition comprised of a carrier liquid, a polysilylene, a poly(germylene), or mixtures thereof, and a charge director.

15. A liquid toner composition in accordance with claim 18 wherein the liquid is a petroleum distillate.

16. A liquid toner composition in accordance with claim 15 wherein the charge director is present in an amount of from about 0.1 to about 15 weight precent.

17. A liquid toner composition in accordance with claim 15 wherein the petroleum distillate is an Isopar.

18. A liquid toner composition in accordance with claim 15 wherein the polysilylene is poly(methylphenyl) silylene, poly(cyclohexyl methyl) silylene, poly(-beta-phenethylmethylsilylene), poly(n-propylmethyl silylene)-co-methylphenyl silylene, or poly(n-propylmethyl silylene).

19. A toner composition in accordance with claim 3 wherein the glass transition temperature thereof is from about 50° to about ° C.

20. A toner composition in accordance with claim 3 wherein the melting point is from about 50° C. about 120°0 C.

21. A xerographic process which comprises forming a latent image on an imaging member, developing the image with the toner composition of claim 2, and subsequently tranferring the developed image to a substrate.

22. A xerographic process which comprises forming a latent image on an imaging member, developing the image with a toner composition of claim 3, and subsequently transferring the developed image to a substrate.

23. An imaging process in accordance with claim 22 wherein fixing is accomplished with substantially no toner offsetting occuring.

24. A low melting toner composition comprised of a polysilylene, a poly(germylene), or mixtures thereof, and a pigment or dye.

25. A toner composition in accordance with claim 24 wherein a pigment is selected.

26. A toner composition in accordance with claim 24 wherein the toner melting temperature is from about 50° to about 150° C.

27. A toner composition comprised of a polysilylene and a pigment.

28. A toner composition in accordance with claim 27 wherein the pigment is carbon black, magnetite or mixtures thereof.

29. A toner composition in accordance with claim 27 wherein the polysilylene is of the formula

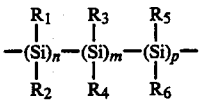

wherein $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that represent the percentage of the monomer unit in the total polymer.

30. A toner composition comprised of a polysilylene, a pigment, and a charge enhancing additive.

31. A toner composition in accordance with claim 30 wherein the change enhancing additive is selected from the group consisting of alkyl pyridinium halides, cetyl pyridinium tetafluoroborates, quaternary ammonium sulfates and sulfonates, stearyl phenethyl dimethyl ammonium tosylate, distearyl dimethyl ammonium sulfate, stearyl dimethyl hydrogen ammonium tosylate, and quaternary ammonium salts.

32. A toner composition in accordance with claim 1 wherein the change enhancing additive is selected from the group consisting of alkyl pyridinium halides, cetyl pyridinium tetrafluoroborates, quaternary ammonium sulfates and sulfonates, stearyl phenethyl dimethyl ammonium tosylate, distearyl dimethyl ammonium sulfate, stearyl dimethyl hydrogen ammonium tosylate, and quaternary ammonium salts.

33. A toner composition in accordance with claim 4 wherein the change enhancing additive is selected from the group consisting of alkyl pyridinium halides, cetyl pyridinium tetrafluoroborates, quaternary ammonium sulfates and sulfonates, stearyl phenethyl dimethyl ammonium tosylate, distearyl dimethyl ammonium sulfate, stearyl dimethyl hydrogen ammonium tosylate, and quaternary ammonium salts.

34. A developer composition comprised of the toner composition of claim 27 and carrier particles.

35. A developer composition in accordance with claim 34 wherein the carrier contains a polymeric coating.

* * * * *